US008574427B2

(12) United States Patent
Mezza et al.

(10) Patent No.: US 8,574,427 B2
(45) **Date of Patent: *Nov. 5, 2013**

(54) PROCESS FOR REMOVING REFRACTORY NITROGEN COMPOUNDS FROM VACUUM GAS OIL

(75) Inventors: Beckay J. Mezza, Arlington Heights, IL (US); Haiyan Wang, Hoffman Estates, IL (US); Alakananda Bhattacharyya, Glen Ellyn, IL (US); Christopher P. Nicholas, Evanston, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/555,769

(22) Filed: Jul. 23, 2012

(65) Prior Publication Data

US 2013/0153464 A1 Jun. 20, 2013

Related U.S. Application Data

(60) Provisional application No. 61/570,957, filed on Dec. 15, 2011.

(51) Int. Cl.

| | |
|---|---|
| ***C10G 21/24*** | (2006.01) |
| ***C10G 21/12*** | (2006.01) |
| ***C10G 21/06*** | (2006.01) |
| ***C07C 7/10*** | (2006.01) |

(52) U.S. Cl.
USPC ..... 208/87; 208/57; 208/254 R; 208/311; 585/864

(58) Field of Classification Search
CPC ..... C10G 21/06; C10G 21/08; C10G 21/12; C10G 21/16; C10G 21/18; C10G 21/20; C10G 21/22; C10G 21/24; C10G 21/28
USPC ..... 208/87, 89, 96, 187, 188, 208 R, 211, 208/236, 237, 238, 251 R, 254 R, 262.1, 208/265, 289, 292, 298, 311, 57; 585/860, 585/864, 865, 867
See application file for complete search history.

(56) References Cited

U.S. PATENT DOCUMENTS

| | | | | |
|---|---|---|---|---|
| 2,413,099 | A | 12/1946 | Cox | |
| 2,654,766 | A | 10/1953 | Taussky | |
| 2,981,678 | A | 4/1961 | Buningh et al. | |
| 4,359,596 | A * | 11/1982 | Howard et al. | 585/856 |
| 4,376,040 | A * | 3/1983 | Sader | 208/180 |
| 4,483,763 | A | 11/1984 | Kuk et al. | |
| 4,747,936 | A | 5/1988 | Penning | |
| 4,992,210 | A | 2/1991 | Naeger et al. | |
| 5,494,572 | A * | 2/1996 | Horii et al. | 208/263 |
| 5,817,228 | A | 10/1998 | Greaney et al. | |
| 5,961,821 | A | 10/1999 | Varadaraj et al. | |
| 6,013,176 | A | 1/2000 | Greaney et al. | |
| 6,096,196 | A | 8/2000 | Varadaraj et al. | |
| 6,139,723 | A | 10/2000 | Pelrine et al. | |
| 6,464,859 | B1 | 10/2002 | Duncum et al. | |
| 6,596,914 | B2 | 7/2003 | Gore et al. | |
| 6,881,325 | B2 | 4/2005 | Morris et al. | |
| 7,001,504 | B2 | 2/2006 | Schoonover | |
| 7,019,188 | B2 * | 3/2006 | Smith et al. | 585/809 |
| 7,198,712 | B2 * | 4/2007 | Olivier-Bourbigou et al. | 208/238 |
| 7,252,756 | B2 | 8/2007 | Gong et al. | |
| 7,553,406 | B2 * | 6/2009 | Wasserscheid et al. | 208/236 |
| 7,749,377 | B2 | 7/2010 | Serban et al. | |
| 7,914,688 | B2 | 3/2011 | Anderson et al. | |
| 8,343,336 | B2 | 1/2013 | Hamad et al. | |
| 2004/0202771 | A1 | 10/2004 | Lee | |
| 2007/0000809 | A1 | 1/2007 | Lin et al. | |
| 2008/0221353 | A1 * | 9/2008 | Tsunashima | 564/12 |
| 2008/0245705 | A1 * | 10/2008 | Siskin et al. | 208/177 |
| 2009/0057232 | A1 | 3/2009 | Angeles-Boza et al. | |
| 2009/0101592 | A1 | 4/2009 | Anderson et al. | |
| 2009/0119979 | A1 | 5/2009 | Mullen | |
| 2009/0234146 | A1 | 9/2009 | Cooney et al. | |
| 2009/0288992 | A1 * | 11/2009 | Victorovna Likhanova et al. | 208/237 |
| 2010/0051509 | A1 * | 3/2010 | Martinez Palou et al. | 208/237 |
| 2010/0243532 | A1 | 9/2010 | Myers et al. | |
| 2010/0270211 | A1 * | 10/2010 | Wolny | 208/243 |
| 2011/0155635 | A1 | 6/2011 | Serban et al. | |

(Continued)

FOREIGN PATENT DOCUMENTS

| | | | |
|---|---|---|---|
| CN | 1657596 | A | 8/2005 |
| CN | 1847366 | A | 10/2006 |

(Continued)

OTHER PUBLICATIONS

Manuela Serban, Joseph Kocal, Peter Kokayeff, and Chris Gosling, Diesel Desulfurization to Make ULSD—Overcoming Nitrogen Inhibition, UOP LLC, AIChE Spring 2008 National Meeting, Presented Apr. 7, 2008.*

Eber, "Deep desulfurization of oil refinery streams by extraction with ionic liquids", Green Chem., 2004, 6, 316-322.

Fan, "Review of researcches and application of room temperature ionic liquids in petroleum industry", Oilfield Chemistry, 24(3), 2007, pp. 283-286, China International Book Trading Corp. (Guoji Shudian).

Marcinkowski, "Alkaline stabilisation of primary sludge part 1. Analyses of lipids", Environment Protection Engineering, v 30, n 3, p. 35-41, 2004.

Peng, "Extraction of Basic Nitrides from FCC Diesel Using Ionic Liquids at Room Temperature", Petroleum Science and Technology, 23:1023-1031, 2005.

Song, "Effective Phase Separation of Biomass Pyrolysis Oils by Adding Aqueous Salt Solutions", Energy & Fuels 2009, 23, 3307-3312.

(Continued)

*Primary Examiner* — Nina Bhat
*Assistant Examiner* — Jonathan Miller
(74) *Attorney, Agent, or Firm* — Mark Goldberg

(57) ABSTRACT

A process for removing a refractory nitrogen compound from a hydroprocessed vacuum gas oil feed includes contacting the hydroprocessed vacuum gas oil feed comprising the nitrogen compound with a VGO-immiscible phosphonium ionic liquid to produce a hydroprocessed vacuum gas oil and VGO-immiscible phosphonium ionic liquid mixture, and separating the mixture to produce a hydroprocessed vacuum gas oil effluent having a reduced refractory nitrogen compound content relative to the vacuum gas oil feed.

18 Claims, No Drawings

(56) References Cited

U.S. PATENT DOCUMENTS

| | | | | |
|---|---|---|---|---|
| 2011/0155637 | A1* | 6/2011 | Serban et al. | 208/88 |
| 2011/0155638 | A1 | 6/2011 | Bhattacharyya et al. | |
| 2011/0155644 | A1 | 6/2011 | Bhattacharyya et al. | |
| 2011/0155645 | A1 | 6/2011 | Serban et al. | |
| 2011/0155647 | A1 | 6/2011 | Serban et al. | |
| 2011/0203972 | A1* | 8/2011 | Gargano et al. | 208/236 |
| 2012/0152804 | A1* | 6/2012 | Koseoglu et al. | 208/80 |
| 2013/0153470 | A1 | 6/2013 | Mezza et al. | |
| 2013/0158279 | A1 | 6/2013 | Mezza et al. | |

FOREIGN PATENT DOCUMENTS

| | | | | |
|---|---|---|---|---|
| EP | 1854786 | A1 * | 11/2007 | C07D 213/84 |
| JP | 11241074 | A | 9/1999 | |
| WO | WO 2007138307 | A2 * | 12/2007 | C10F 21/27 |
| WO | 2009017425 | A1 | 2/2009 | |
| WO | 2009030894 | A1 | 3/2009 | |

OTHER PUBLICATIONS

Vidal, "Studies on the Use of Ionic Liquids as Potential Extractants of Phenolic Compounds and Metal Ions", Separation Science and Technology, vol. 39, No. 9. pp. 2155-2169, 2004.

Visser, "Liquid/Liquid Extraction of Metal Ions in Room Temperature Ionic Liquids", Separation Science and Technology, 36(5&6), 785-804 (2001).

Wei, "Room temperature ionic liquid as a novel medium for liquid/liquid extraction of metal ions", Analytica Chimica Acta 488 (2003) 183-192.

Xie, "Selective Extraction and Identification of Neutral Nitrogen Compounds Contained in Straight-Run Diesel Feed Using Chloride Based Ionic Liquid", Ind. Eng. Chem. Res. 2008, 47, 8801-8807.

Zhang, "Microwave-assisted conversion of lignocellulosic biomass into furans in ionic liquid", Bioresource Technology 101 (2010) 1111-1114.

* cited by examiner

PROCESS FOR REMOVING REFRACTORY NITROGEN COMPOUNDS FROM VACUUM GAS OIL

CROSS-REFERENCE TO RELATED APPLICATION

This application claims priority from Provisional application No. 61/570,957 filed Dec. 15, 2011, the contents of which are hereby incorporated by reference.

FIELD OF THE INVENTION

This invention relates to processes for reducing the nitrogen content of vacuum gas oils (VGO). More particularly, the invention relates to removing refractory nitrogen contaminants from VGO using an ionic liquid in combination with hydroprocessing.

BACKGROUND OF THE INVENTION

VGO is a hydrocarbon fraction that may be converted into higher value hydrocarbon fractions such as diesel fuel, jet fuel, naphtha, gasoline, and other lower boiling fractions in refining processes such as hydrocracking and fluid catalytic cracking (FCC). However, VGO feed streams having higher amounts of nitrogen are more difficult to convert. For example, the degree of conversion, product yields, catalyst deactivation, and/or ability to meet product quality specifications may be adversely affected by the nitrogen content of the feed stream. It is known to reduce the nitrogen content of VGO by catalytic hydrogenation reactions such as in a hydrotreating process unit. The current economic conditions and oil reserve situation worldwide have resulted in a growing interest in processing heavy oils and even extra-heavy oils with a much higher nitrogen content. There has been an increase in the nitrogen content of feeds to hydrocrackers in recent years. Removal of nitrogen is essential to prevent catalyst poisoning in downstream refinery processes such as hydrocracking (HC), catalytic cracking, and reforming. Organic nitrogen can be removed catalytically by hydrodenitrogenation (HDN), which is one of the most difficult hydrotreatment reactions.

Most of the difficult to remove nitrogen is present as heterocycles with multiple aromatic rings. The N-containing compounds are usually divided into two classes, basic and neutral compounds. Basic nitrogen compounds are primarily 6-membered-ring nitrogen compounds, such as quinolines and benzoquinolines. Nonbasic compounds are primarily 5-membered-ring compounds, such as indoles and carbazoles. Half of the total nitrogen is typically concentrated in the heaviest 30% of heavy feeds, with carbazole compounds substituted at position 1 being the most abundant. Di and trimethylcarbazoles with substitution at position 1 have been observed to be the most predominant. The problem of nitrogen compound inhibition has received considerable attention because the effects influence both process and catalyst development. Organic nitrogen compounds have a significantly negative kinetic effect on hydrotreating reactions such as hydrodesulfurization (HDS), on other hydrogenolysis reactions, and on hydrogenation reactions. The poisoning of the more acidic catalysts employed in hydrocracking caused by nitrogen compounds is even more severe, and the detrimental effect is reflected in the performance of the hydrocrackers. In particular, refractory nitrogen compounds with aromatic rings are resistant to reaction during hydrotreating processes that are currently used.

Hydroprocessing includes processes which convert hydrocarbons in the presence of hydroprocessing catalyst and hydrogen to more valuable products.

Hydrocracking is a hydroprocessing process in which hydrocarbons crack in the presence of hydrogen and hydrocracking catalyst to lower molecular weight hydrocarbons. Depending on the desired output, a hydrocracking unit may contain one or more beds of the same or different catalyst. Slurry hydrocracking is a slurried catalytic process used to crack residue feeds to gas oils and fuels. Hydrotreating is a hydroprocessing process used to remove heteroatoms such as sulfur and nitrogen from hydrocarbon streams to meet fuel specifications and to saturate olefinic compounds. Hydrotreating can be performed at high or low pressures, but is typically operated at lower pressure than hydrocracking.

Various processes using ionic liquids to remove sulfur and nitrogen compounds from hydrocarbon fractions are known. U.S. Pat. No. 7,001,504 B2 discloses a process for the removal of organosulfur compounds from hydrocarbon materials which includes contacting an ionic liquid with a hydrocarbon material to extract sulfur containing compounds into the ionic liquid. U.S. Pat. No. 7,553,406 B2 discloses a process for removing polarizable impurities from hydrocarbons and mixtures of hydrocarbons using ionic liquids as an extraction medium. U.S. Pat. No. 7,553,406 B2 also discloses that different ionic liquids show different extractive properties for different polarizable compounds. However, these processes do not show utility in removing refractory nitrogen compounds.

There remains a need for improved processes that enable the removal of compounds comprising refractory nitrogen from vacuum gas oil (VGO) either before or after hydrotreating. These refractory nitrogen compounds are difficult to remove by hydrotreating or hydroprocessing.

SUMMARY OF THE INVENTION

The present invention is a process for removing refractory nitrogen compounds from a vacuum gas oil comprising contacting the vacuum gas oil with a VGO-immiscible phosphonium ionic liquid to produce a processed vacuum gas oil and VGO-immiscible phosphonium ionic liquid mixture, and separating the mixture to produce a processed vacuum gas oil effluent and a VGO-immiscible phosphonium ionic liquid effluent comprising the refractory nitrogen compound. The vacuum gas oil is subjected to hydroprocessing before or after the contact with the VGO-immiscible phosphonium ionic liquid or between periods of contact with the VGO-immiscible phosphonium ionic liquid.

The VGO-immiscible phosphonium ionic liquid comprises at least one ionic liquid from at least one of the following ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides. In another embodiment, the VGO-immiscible phosphonium ionic liquid comprises at least one of trihexyl(tetradecyl) phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)

phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate.

There are numerous embodiments of the invention in which a process of treating hydrocarbons involves combinations of ionic liquid extraction and hydrotreating. The following are three representative combinations of ionic liquid extraction and hydrotreating In one configuration, an ionic liquid extraction step is applied after hydrotreating. The ionic liquids remove specific refractory nitrogen compounds remaining after hydrotreating that are harmful for downstream catalyst. When the ionic liquid contact step occurs following the hydrotreating step this may allow the hydrotreating process to be run at lower severity, thereby potentially decreasing processing cost.

In another configuration, ionic liquid extraction is employed to remove refractory nitrogen compounds before the hydrocarbons enter the hydrotreater. This can enhance the desulfurization efficiency and lower the severity of hydrotreating.

In a third configuration, ionic liquid extraction is conducted both before and after hydrotreating. This encompasses both benefits of the two different combinations shown above but likely imposes additional capital cost. The ionic liquid can be recycled back and forth between two stages of ionic liquid extraction.

Other configurations may be employed as well, such as multiple hydrotreating steps and multiple ionic liquid extraction steps in order to produce a product stream with the desired level of purity.

DETAILED DESCRIPTION OF THE INVENTION

In general, the invention may be used to remove a refractory nitrogen compound from a hydroprocessed vacuum gas oil (VGO) hydrocarbon fraction through use of a VGO-immiscible phosphonium ionic liquid. The invention may also be used to remove a refractory nitrogen compound from a vacuum gas oil prior to hydroprocessing of the vacuum gas oil.

The terms "vacuum gas oil", "VGO", "VGO phase" and similar terms relating to vacuum gas oil as used herein are to be interpreted broadly to receive not only their ordinary meanings as used by those skilled in the art of producing and converting such hydrocarbon fractions, but also in a broad manner to account for the application of our processes to hydrocarbon fractions exhibiting VGO-like characteristics. Thus, the terms encompass straight run VGO, as may be produced in a crude fractionation section of an oil refinery, as well as VGO product cuts, fractions, or streams that may be produced, for example, by coker, deasphalting, and visbreaking processing units, or which may be produced by blending various hydrocarbons. In the present invention, the vacuum gas oil is subjected to hydroprocessing, either before or after the use of the ionic liquid to remove a substantial amount of refractory nitrogen compounds.

The term "refractory nitrogen compound" refers to nitrogen-containing heterocyclic compounds that may survive during a hydrotreatment process. They possess aromatic rings and often have multiple aromatic rings. Refractory nitrogen compounds may be either basic or nonbasic although major ones are believed to be nonbasic. Nonbasic nitrogen compounds refer to 5-membered ring compounds such as indoles, carbazoles, naphthenic carbazoles and benzocarbazoles. Carbazole compounds substituted at position 1 are among the most predominant refractory nitrogen compounds. Recently, 4,8,9,10-tetrahydrocyclohepta[def]carbazoles was identified as the most refractory organic nitrogen compounds in a hydrotreated vacuum gas oil [Peter Wiwel, Berit Hinnemann, Angelica Hidalgo-Vivas, Per Zeuthen, Bent O. Petersen, and Jens Ø. Duus Ind. Eng. Chem. Res. 2010, 49, 3184-3193]. Basic nitrogen compounds include 6-membered ring nitrogen compounds, such as acridines, naphthenic acridines and benzacridines. The refractory nitrogen compounds removed in the process of this invention include at least one compound selected from the group consisting of indoles and naphthenic indoles, quinolines and naphthenic quinolines, carbazoles and naphthenic carbazoles, acridines and naphthenic acridines, benzocarbazole and naphthenic benzocarbazoles, benzacridines and naphthenic benzacridines, and dibenzocarbazoles and naphthenic dibenzocarbazoles.

The term "hydroprocessing" as referred to herein includes both hydrocracking and hydrotreating. Hydrocracking refers to a process in which hydrocarbons crack in the presence of hydrogen to lower molecular weight hydrocarbons. Hydrocracking also includes slurry hydrocracking in which resid feed is mixed with catalyst and hydrogen to make a slurry and cracked to lower boiling products. VGO in the products may be recycled to manage coke precursors referred to as mesophase. Hydrotreating is a process wherein hydrogen is contacted with hydrocarbon in the presence of suitable catalysts which are primarily active for the removal of heteroatoms, such as sulfur, nitrogen and metals from the hydrocarbon feedstock. Catalysts for hydrotreating are usually metal sulfides from groups 6, 8, 9 and 10 of the periodic table, preferably nickel, molybdenum, tungsten or cobalt dispersed on a metal oxide, preferably alumina. In hydrotreating, hydrocarbons with double and triple bonds may be saturated. Aromatics may also be saturated. However, it has been found that hydrotreating is ineffective in removal of certain refractory heteroatoms.

In general, VGO comprises petroleum hydrocarbon components boiling in the range of from about 100° to about 720° C. In an embodiment the VGO boils from about 250° to about 650° C. and has a density in the range of from about 0.87 to about 0.95 g/cm$^3$. In another embodiment, the VGO boils from about 95° to about 580° C.; and in a further embodiment, the VGO boils from about 300° to about 720° C. Generally, VGO may contain from about 100 to about 30,000 ppm-wt nitrogen. In an embodiment, the nitrogen content of the VGO ranges from about 10 to about 20000 ppm-wt. The total nitrogen content may be determined using ASTM method D4629-02, Trace Nitrogen in Liquid Petroleum Hydrocarbons by Syringe/Inlet Oxidative Combustion and Chemiluminescence Detection and the sulfur content may be determined using ASTM method D5453-00, Ultraviolet Fluorescence. Unless otherwise noted, the analytical methods used herein such as ASTM D4629-02 are available from ASTM International, 100 Barr Harbor Drive, West Conshohocken, Pa., USA.

Processes according to the invention remove a refractory nitrogen compound from vacuum gas oil. That is, the invention removes at least one refractory nitrogen compound. It is understood that vacuum gas oil will usually comprise a plurality of refractory nitrogen compounds of different types in various amounts. Thus, the invention removes at least a portion of at least one type of refractory nitrogen compound from the VGO. The invention may remove the same or different amounts of each type of refractory nitrogen compound, and some types of refractory nitrogen compounds may not be removed. The amount of nitrogen compounds removed will depend upon the volume of ionic liquid used as well as the number of times that a VGO is contacted with the ionic liquid. The nitrogen compound content removed may be about 10 wt %. In another embodiment, the nitrogen compound content of the vacuum gas oil is reduced by at least 40 wt %. Preferably, the nitrogen compound content of the vacuum gas oil is reduced by at least 60 wt %. More preferably, the nitrogen compound content of the vacuum gas oil is reduced by at least 90 wt %.

One or more ionic liquids are used to extract one or more refractory nitrogen compounds from VGO. Generally, ionic liquids are non-aqueous, organic salts composed of ions where the positive ion is charge balanced with negative ion. These materials have low melting points, often below 100° C., undetectable vapor pressure and good chemical and thermal stability. The cationic charge of the salt is localized over hetero atoms such as nitrogen, phosphorous, sulfur, arsenic, boron, antimony, and aluminum, and the anions may be any inorganic, organic, or organometallic species.

Ionic liquids suitable for use in the instant invention are VGO-immiscible phosphonium ionic liquids. As used herein the term "VGO-immiscible phosphonium ionic liquid" means an ionic liquid having a cation comprising at least one phosphorous atom and which is capable of forming a separate phase from VGO under operating conditions of the process. Ionic liquids that are miscible with VGO at the process conditions will be completely soluble with the VGO; therefore, no phase separation will be feasible. Thus, VGO-immiscible phosphonium ionic liquids may be insoluble with or partially soluble with VGO under operating conditions. A phosphonium ionic liquid capable of forming a separate phase from the vacuum gas oil under the operating conditions is considered to be VGO-immiscible. Ionic liquids according to the invention may be insoluble, partially soluble, or completely soluble (miscible) with water.

The VGO-immiscible phosphonium ionic liquid comprises at least one ionic liquid from at least one of the following groups of ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halide. More specifically, the VGO-immiscible phosphonium ionic liquid comprises at least one of trihexyl(tetradecyl)phosphonium chloride, trihexyl(tetradecyl)phosphonium bromide, tributyl (methyl)phosphonium bromide, tributyl(methyl)phosphonium chloride, tributyl(hexyl)phosphonium bromide, tributyl (hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl) phosphonium diethylphosphate, and tetrabutylphosphonium methanesulfonate. In a further embodiment, the VGO-immiscible phosphonium ionic liquid is selected from the group consisting of trihexyl(tetradecyl)phosphonium chloride, trihexyl(tetradecyl)phosphonium bromide, tributyl(methyl) phosphonium bromide, tributyl(methyl)phosphonium chloride, tributyl(hexyl)phosphonium bromide, tributyl(hexyl) phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl) phosphonium diethylphosphate, tetrabutylphosphonium methanesulfonate, and combinations thereof. The VGO-immiscible phosphonium ionic liquid may be selected from the group consisting of trihexyl(tetradecyl)phosphonium halides, tetraalkylphosphonium dialkylphosphates, tetraalkylphosphonium tosylates, tetraalkylphosphonium sulfonates, tetraalkylphosphonium halides, and combinations thereof. The VGO-immiscible phosphonium ionic liquid may comprise at least one ionic liquid from at least one of the following groups of ionic liquids trihexyl(tetradecyl)phosphonium halides, tetraalkylphosphonium dialkylphosphates, tetraalkylphosphonium tosylates, tetraalkylphosphonium sulfonates, and tetraalkylphosphonium halides.

In an embodiment, the invention is a process for removing refractory nitrogen compounds from vacuum gas oil (VGO) comprising a hydroprocessing step, a contacting step and a separating step. In the hydroprocessing step, the VGO is contacted with hydrogen in the presence of a catalyst to remove a portion of the heteroatom containing molecules. Greater than 50% of the sulfur content or greater than 50% of the nitrogen content or greater than 50% of the sulfur and nitrogen content of the VGO may be removed. In the contacting step, the vacuum gas oil comprising a refractory nitrogen compound and a VGO-immiscible phosphonium ionic liquid are contacted or mixed. The contacting may facilitate transfer or extraction of the one or more refractory nitrogen compounds from the VGO to the ionic liquid. Although a VGO-immiscible phosphonium ionic liquid that is partially soluble in VGO may facilitate transfer of the refractory nitrogen compound from the VGO to the ionic liquid, partial solubility is not required. Insoluble vacuum gas oil/ionic liquid mixtures may have sufficient interfacial surface area between the VGO and ionic liquid to be useful. In the separation step, the mixture of vacuum gas oil and ionic liquid settles or forms two phases, a VGO phase and an ionic liquid phase, which is separated to produce a VGO-immiscible phosphonium ionic liquid effluent and a vacuum gas oil effluent. In a further embodiment, the vacuum gas oil effluent is then passed to a hydrocarbon conversion process comprising either catalytic cracking or hydroprocessing. In an alternate embodiment, the invention is a process for removing refractory nitrogen compounds from vacuum gas oil (VGO) comprising a contacting step and a separating step followed by a hydrotreating step.

The process may be conducted in equipment which are well known in the art and are suitable for batch or continuous operation. For example, in the invention, VGO and a VGO-immiscible phosphonium ionic liquid may be mixed in a vessel, e.g., by stirring, shaking, use of a mixer, or a magnetic stirrer. The mixing or agitation is stopped and the mixture forms a VGO phase and an ionic liquid phase which can be separated, for example, by decanting, centrifugation, settler or other separation method to produce a vacuum gas oil effluent having lower refractory nitrogen compound content relative to the vacuum gas oil. The process may involve counter current flow of the VGO passing in one direction and an ionic liquid in the other direction. The process also produces a VGO-immiscible phosphonium ionic liquid effluent comprising the one or more refractory nitrogen compounds.

The contacting and separating steps may be repeated for example when the nitrogen content of the vacuum gas oil effluent is to be reduced further to obtain a desired nitrogen level in the ultimate VGO product stream from the process. Each set, group, or pair of contacting and separating steps may be referred to as a refractory nitrogen compound removal step. Thus, the invention encompasses single and multiple nitrogen removal steps. A nitrogen removal zone may be used to perform a refractory nitrogen compound removal step. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The refractory nitrogen compound removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

In an embodiment of the invention a refractory nitrogen compound is removed in an extraction zone that comprises a multi-stage, counter-current extraction column wherein vacuum gas oil and VGO-immiscible phosphonium ionic liquid are contacted and separated. Consistent with common terms of art, the ionic liquid introduced to the nitrogen removal step may be referred to as a "lean ionic liquid" generally meaning a VGO-immiscible phosphonium ionic liquid that is not saturated with one or more extracted refractory nitrogen compounds. Lean ionic liquid may include one or both of fresh and regenerated ionic liquid and is suitable for accepting or extracting refractory nitrogen compounds from the VGO feed. Likewise, the ionic liquid effluent may be referred to as "rich ionic liquid", which generally means a VGO-immiscible phosphonium ionic liquid effluent produced by a refractory nitrogen compound removal step or process or otherwise including a greater amount of extracted refractory nitrogen compounds than the amount of extracted refractory nitrogen compounds included in the lean ionic liquid. A rich ionic liquid may require regeneration or dilution, e.g. with fresh ionic liquid, before recycling the rich ionic liquid to the same or another nitrogen removal step of the process.

The refractory nitrogen compound removal step may be conducted under conditions including temperatures and pressures sufficient to keep the VGO-immiscible phosphonium ionic liquid and VGO feeds and effluents as liquids. For example, the nitrogen removal step temperature may range between about 10° C. and less than the decomposition temperature of the phosphonium ionic liquid; and the pressure may range between about atmospheric pressure and about 700 kPa(g). When the VGO-immiscible ionic liquid comprises more than one ionic liquid component, the decomposition temperature of the ionic liquid is the lowest temperature at which any of the ionic liquid components decompose. The refractory nitrogen compound removal step may be conducted at a uniform temperature and pressure or the contacting and separating steps of the refractory nitrogen compound removal step may be operated at different temperatures and/or pressures. In an embodiment, the contacting step is conducted at a first temperature, and the separating step is conducted at a temperature at least 5° C. lower than the first temperature. In a non limiting example, the first temperature is about 80° C. Such temperature differences may facilitate separation of the VGO and ionic liquid phases.

The above and other refractory nitrogen compound removal step conditions such as the contacting or mixing time, the separation or settling time, and the ratio of VGO feed to VGO-immiscible phosphonium ionic liquid (lean ionic liquid) may vary greatly based, for example, on the specific ionic liquid or liquids employed, the nature of the VGO feed (straight run or previously processed), the nitrogen content of the VGO feed, the degree of refractory nitrogen compound removal required, the number of steps employed, and the specific equipment used. In general it is expected that contacting time may range from less than one minute to about two hours; settling time may range from about one minute to about eight hours; and the weight ratio of VGO feed to lean ionic liquid introduced to the nitrogen removal step may range from 1:10,000 to 10,000:1. In an embodiment, the weight ratio of VGO feed to lean ionic liquid may range from about 1:1,000 to about 1,000:1; and the weight ratio of VGO feed to lean ionic liquid may range from about 1:100 to about 100:1. In an embodiment the weight of VGO feed is greater than the weight of ionic liquid introduced to the nitrogen removal step.

In an embodiment, a single refractory nitrogen refractory removal step reduces the nitrogen content of the vacuum gas oil by at least about 10 wt % and in some instances by more than about 40 wt %. In another embodiment, more than about 50% of the nitrogen by weight is extracted or removed from the VGO feed in a single refractory nitrogen compound removal step; and more than about 60% of the refractory nitrogen by weight may be extracted or removed from the VGO feed in a single nitrogen removal step. Up to 100 wt % of the nitrogen refractory compounds may be removed in one or more nitrogen removal steps. As discussed herein the invention encompasses multiple nitrogen removal steps to provide the desired amount of nitrogen removal. The degree of phase separation between the VGO and ionic liquid phases is another factor to consider as it affects recovery of the ionic liquid and VGO. The degree of nitrogen removed and the recovery of the VGO and ionic liquids may be affected differently by the nature of the VGO feed, the specific ionic liquid or liquids, the equipment, and the nitrogen removal conditions such as those discussed above.

The amount of water present in the vacuum gas oil/VGO-immiscible phosphonium ionic liquid mixture during the refractory nitrogen compound removal step may also affect the amount of nitrogen removed and/or the degree of phase separation, i.e., recovery of the VGO and ionic liquid. In an embodiment, the VGO/VGO-immiscible phosphonium ionic liquid mixture has a water content of less than about 50% relative to the weight of the ionic liquid. In another embodiment, the water content of the VGO/VGO-immiscible phosphonium ionic liquid mixture is less than about 5% relative to the weight of the ionic liquid; and the water content of the VGO/VGO-immiscible phosphonium ionic liquid mixture may be less than about 2% relative to the weight of the ionic liquid. In a further embodiment, the VGO/VGO-immiscible phosphonium ionic liquid mixture is water free, i.e., the mixture does not contain water.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving refractory nitrogen compound removal, washing, and regeneration zones may pass through ancillary equipment such as heat exchanges within the zones. Streams, including recycle streams, introduced to washing or extraction zones may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. Examples include: various streams comprising ionic liquid and water may be dried and/ or passed to other zones to provide all or a portion of the water and/or ionic liquid required by the destination zone. The various process steps may be operated continuously and/or intermittently as needed for a given embodiment e.g. based on the quantities and properties of the streams to be processed in such steps. As discussed above the invention encompasses multiple refractory nitrogen compound removal steps, which may be performed in parallel, sequentially, or a combination thereof. Multiple nitrogen compound removal steps may be performed within the same refractory nitrogen compound removal zone and/or multiple refractory nitrogen compound removal zones may be employed with or without intervening washing, regeneration and/or drying zones. After treatment with an ionic liquid, the vacuum gas oil effluent may be sent to a hydrocarbon conversion process such as catalytic cracking or hydroprocessing. The VGO-immiscible phosphonium ionic liquid effluent may be contacted with a regeneration solvent and the VGO-immiscible phosphonium ionic liquid effluent separated from the regeneration solvent to produce an extract stream comprising the refractory nitrogen compound and a regenerated VGO-immiscible phosphonium ionic liquid stream. A portion of the regenerated VGO-immiscible phosphonium ionic liquid stream may be recycled to the refractory nitrogen compound removal contacting step. The regeneration solvent comprises a lighter hydrocarbon fraction relative to the vacuum gas oil and the extract stream further comprises the lighter hydrocarbon fraction, the lighter hydrocarbon fraction being immiscible with the VGO-immiscible phosphonium ionic liquid. The regeneration solvent may comprise water. The vacuum gas oil effluent that comprises the VGO-immiscible phosphonium ionic liquid, can then be washed so that at least a portion of the vacuum gas oil effluent is washed with water to produce a washed vacuum gas oil and a spent water stream, the spent water stream comprising the VGO-immiscible phosphonium ionic liquid; wherein at least a portion of the spent water stream is at least a portion of the regeneration solvent. The process further comprises drying at least a portion of at least one of the regenerated VGO-immiscible phosphonium ionic liquid stream, and the spent water stream to produce a dried VGO-immiscible phosphonium ionic liquid stream. The process further comprises recycling at least a portion of the dried VGO-immiscible phosphonium ionic liquid stream to the refractory nitrogen compound removal contacting step.

There are numerous embodiments of the invention in which a process of treating hydrocarbons involves combinations of ionic liquid extraction and hydrotreating. The following are three representative combinations of ionic liquid extraction and hydrotreating In one configuration, an ionic liquid extraction step is applied after hydrotreating. The ionic liquids remove specific nitrogen compounds that remain that are harmful for downstream catalyst. Having the ionic liquid contact step following the hydrotreating step allows the hydrotreating process to run a lower severity conditions, thereby decreasing processing cost.

In another configuration, ionic liquid extraction is employed to remove a majority of nitrogen compounds before the hydrocarbons enter the hydrotreater. This can enhance the desulfurization efficiency and lower the severity of hydrotreating.

In a third configuration, ionic liquid extraction is conducted both before and after hydrotreating. This encompasses both benefits of the two different combinations shown above but is likely to impose higher capital cost. The ionic liquid can be recycled back and forth between two stages of ionic liquid extraction.

Other configurations may be employed as well, such as multiple hydrotreating steps and multiple ionic liquid extraction steps in order to produce a product stream with the desired level of purity.

EXAMPLES

The examples are presented to further illustrate some aspects and benefits of the invention and are not to be considered as limiting the scope of the invention.

Example 1

The following data illustrates that VGO-immiscible phosphonium ionic liquids provide superior performance in removing refractory nitrogen compounds from hydroprocessed vacuum gas oil.

The following Table 1 shows the effectiveness in removal of refractory nitrogen compounds from hydrotreated vacuum gas oils using Cyphos 106 (triisobutylmethyl phosphonium tosylate) (Cytec Industries Inc., Woodland Park, N.J.):

TABLE 1

| HDT VGO Feed | HDT VGO #1 | HDT VGO #2 | HDT VGO #3 | HDT VGO #4 |
|---|---|---|---|---|
| API (°) | 27.79 | 26.53 | 26.92 | 28.33 |
| N before IL Extraction (wt ppm) | 215 | 552 | 378 | 134 |
| Temperature (° C.) | 80 | 80 | 80 | 80 |
| Time (minutes) | 30 | 30 | 30 | 30 |
| Ratio (VGO/IL) | 2:1 | 2:1 | 2:1 | 2:1 |
| N after IL Extraction (wt ppm) | 74 | 174 | 126 | 52 |
| N Removal by IL (%) | 66.4 | 64.2 | 65.2 | 57.4 |

The nitrogen content was determined using ASTM method D4629-02.

Example 2

In the second example, nitrogen content in one VGO feed was reduced about 69% by conventional hydrotreating. Similarly, the same VGO feed was extracted with Cyphos 106 at a ratio of 1 (VGO/IL) to remove about 60% of nitrogen content. The IL extraction experiment was conducted at 80° C. for 30 minutes. Three analytical tools have been employed to compare the distribution of nitrogen compounds in the original VGO feed, the hydrotreated VGO feed and the extracted VGO. ASTM method D4629, comprehensive two-dimensional gas chromatography coupled with nitrogen chemiluminescence detector (GCxGC-NCD) and Fourier transform ion cyclotron resonance mass spectrometry (FT-ICR MS). GCxGC-NCD is able to provide structural and quantitative information of nitrogen compounds. With the combination of FT-ICR MS and GCxGC-NCD, one is able to quantify individual nitrogen species in VGO. Internal standards were used to obtain quantitative information. Proposed structural identification was based on analytical information obtained from GCxGC-NCD and FT-ICR MS analyses, known process chemistry and published literature [e.g., Peter Wiwel, Berit Hinnemann, Angelica Hidalgo-Vivas, Per Zeuthen, Bent O. Petersen, and Jens Ø. Duus Ind. Eng. Chem. Res. 2010, 49, 3184-3193].

FT-ICR MS is preferred for such analysis due to its capability to separate all nitrogen compounds by carbon number. In such analysis, the testing specimen is first dissolved in either toluene or other appropriate solvents. Then chemicals of interest in the testing specimen are ionized by an atmospheric pressure photoionization (APPI) source. The APPI source is able to ionize polar species such as cycloparaffins, aromatics, oxygenates, thiophenes and nitrogen compounds. The APPI source nebulizes components in the testing specimen at a feed rate of about 200 μL/hr, and the APPI nebulizer temperature is about 350° C. After ionization, the resulting ions are examined by Fourier transform ion cyclotron resonance mass spectrometry (FT-ICR MS), which is a high resolution mass spectrometric (HRMS) technique. This technique measures ions by detecting their cyclotron frequencies in a cell that is located inside a magnetic field. Due to its ultra-high mass resolution, mass accuracy and sensitivity, FT-ICR MS is able to determine the molecular formula of individual chemicals existing in a complex organic mixture. Isomers cannot be distinguished by mass spectrometry alone. Thus, proposed structural identification of compounds is based on known process chemistry and GCxGC-NCD analysis. With internal or external standards, the mass spectrometric technique is able to quantify specific nitrogen compound of interest. During examination, mass spectra are obtained over the mass range of about 125 to about 2,000 amu. The examination includes a series of 300 transients of 4 MW data points that are summed and Fourier transformed for each spectrum. This results in a mass resolution of approximately 320,000 at mass 400 amu. Further, the solvent background is checked between testing specimens to assure that there is no cross contamination. The raw data resulting from the spectrometry technique is then calibrated and processed to identify at least one compound of interest.

In GCxGC-NCD analysis, the sample to be analyzed is injected into a gas chromatograph that is equipped with a two stage thermal "Loop Modulator" system, two different fused silica capillary GC columns and a nitrogen chemiluminescence detector. The modulator serves as an interface between the two GC columns; the first "primary" column is a conventional high resolution capillary GC column coated with a cross-linked methyl silicone stationary phase [for example, 50 m of 0.20 mm ID fused silica capillary, internally coated to a film thickness of 0.5 μm (bonded) with cross-linked methyl silicone, Agilent Technologies, Cat. No. 19091S-001E. Only a portion of the original column (~10 m) is used.], which separates molecules based on volatility. The next "secondary" GC column is coated with cross-linked polyethylene glycol [for example, 50 m of 0.10 mm ID fused silica capillary, internally coated to a film thickness of 0.1 μm (bonded) with poly (ethylene glycol), Supelco, Cat. No. 24343. Only a portion of the original column (~2 m) is used.]; it is short and narrow, for fast GC separations based on the molecular property of polarity. The modulator repetitively accumulates, focuses and re-injects "heart-cut" fractions eluting off the "primary" GC column onto the "secondary" GC column, which is connected to the NCD, which enables detection of nitrogen components. The outcome is a series of high speed chromatograms from the "secondary" GC column which are transformed by computer software into a two-dimensional array; with one dimension representing the retention time from the "primary" GC column and other representing the retention time from the "secondary" GC column. Alternatively, the data can be displayed as a 3-dimensional plot containing a third dimension which represents NCD intensity. The nitrogen composition of the sample is obtained by a normalization technique, wherein the peak volumes of the entire sample are normalized to a total nitrogen value determined by oxidative combustion and chemiluminescence detection (ASTM Test Method D4629).

The following Table compares the effectiveness in removal of nitrogen compounds by hydrotreating and using Cyphos 106:

TABLE 2

| Nitrogen Compound | VGO PPM N | HDT VGO PPM N | HDT DeN % % | IL Extracted VGO PPM N | IL DeN % % | Structure |
|---|---|---|---|---|---|---|
| $C_3$, $C_4$, $C_5$, $C_6$, $C_7$, and $C_8$ substituted carbazoles | 8.1 | 5.4 | 32 | 0.0 | 100 | Structure A |
| $C_9$, $C_{10}$, $C_{11}$, $C_{12}$, $C_{13}$, and $C_8$ substituted carbazoles | 79.9 | 35.8 | 55 | 29.0 | 64 | Structure A |
| $C_3$, $C_4$ and $C_5$ substituted 4,8,9,10-tetrahydrocyclo-hepta[def]carbazoles | 4.7 | 4.6 | 2 | 0.0 | 100 | Structure B |
| $C_6$, $C_7$, $C_8$, $C_9$ and $C_{10}$ substituted 4,8,9,10-tetrahydrocyclo-hepta[def]carbazoles | 73.3 | 37.3 | 49 | 27.5 | 62 | Structure B |
| $C_4$, $C_5$, $C_6$, and $C_7$ substituted benzocarbazoles | 29.6 | 7.2 | 76 | 4.8 | 84 | Structure C |

As shown in Table 2, these nitrogen compounds are difficult to remove by hydrotreating and thus they will be considered as refractory nitrogen compounds for hydrotreating. Clearly, removal of these nitrogen compounds with ionic liquid extraction is more effective than hydrotreating as shown in the table. Alkylation could impact on nitrogen removal with ionic liquid extraction. In this example, ionic liquid extraction efficiency is decreased with higher degree of alkylation. With different ionic liquids, one could tune the extraction selectivity.

Example 3

In the third example, the HDT VGO was extracted with Cyphos 106 at a ratio of 1 (VGO/IL). The experiment was conducted at 80° C. for 30 minutes. Nitrogen content in the HDT VGO was reduced about 64% after Cyphos 106 extraction. The same analytical approaches as in the Example 2 were used to compare the distribution of nitrogen compounds in the HDT VGO and the extracted HDT VGO.

The following Table shows the effectiveness in removal of particular types of refractory nitrogen containing structures using Cyphos 106:

TABLE 3

| DBE | Z | Compounds | HOT VGO PPM N | HDT VGO with IL Extraction PPM N | DeN Efficiency % | Representative Structure |
|---|---|---|---|---|---|---|
| 7 | 11 | Mononaphthenic Indoles/ Quinolines | 2.1 | 0.0 | 100 | |
| 8 | 13 | Dinaphthenic Indoles/ Mononaphthenic Quinolines | 6.9 | 0.0 | 100 | |
| 9 | 15 | Carbazoles | 101.2 | 21.8 | 78 | A |

TABLE 3-continued

| DBE | Z | Compounds | HOT VGO PPM N | HDT VGO with IL Extraction PPM N | DeN Efficiency % | Representative Structure |
|---|---|---|---|---|---|---|
| 10 | 17 | Mononaphthenic Carbazoles/ Acridines | 127.5 | 34.3 | 73 | B |
| 11 | 19 | Dinaphthenic Carbazoles/ Mononaphthenic Benzoquinolines | 104.6 | 30.1 | 71 | |
| 12 | 21 | Benzocarbazoles | 76.0 | 17.8 | 77 | C |
| 13 | 23 | Mononaphthenic Benzocarbazoles/ Benzacridines | 62.4 | 10.3 | 83 | D |
| 14 | 25 | Dinaphthenic Benzocarbazoles/ Mononaphthenic Benzacridines | 34.0 | 5.8 | 83 | |
| 15 | 27 | Dibenzo-carbazoles | 13.2 | 0.4 | 97 | |
| 16 | 29 | Mononaphthenic Dibenzo-carbazoles/ Dibenzacridines | 3.1 | 0.0 | 100 | |

This example demonstrates the removal efficiency of refractory nitrogen compounds remained after hydrotreating of the VGO with ionic liquid extraction. Unlike hydrotreating, aromaticity of nitrogen compounds does not appear to have a strong impact on removing nitrogen in the hydrotreated VGO with ionic liquid extraction.

Structure A

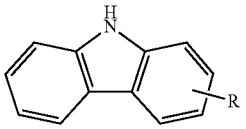

Structure B

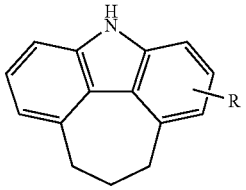

Structure C

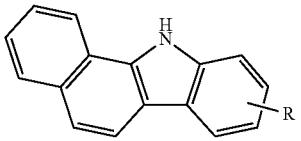

Structure D

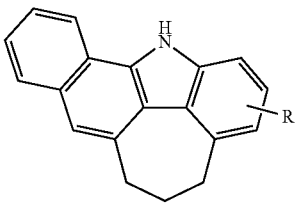

The invention claimed is:

1. A process for removing a refractory nitrogen compound from a vacuum gas oil comprising:

(a) hydroprocessing the vacuum gas oil;

(b) contacting the vacuum gas oil comprising the refractory nitrogen compound with a VGO-immiscible phosphonium ionic liquid to produce a mixture comprising the vacuum gas oil and the VGO-immiscible phosphonium ionic liquid; and (c) separating the mixture to produce a vacuum gas oil effluent and a VGO-immiscible phosphonium ionic liquid effluent, the VGO-immiscible phosphonium ionic liquid effluent comprising the refractory nitrogen compound;

wherein said refractory nitrogen compound comprises at least one compound selected from the group consisting of indoles and naphthenic indoles, quinolines and naphthenic quinolines, carbazoles and naphthenic carbazoles, acridines and naphthenic acridines, benzocarbazole and naphthenic benzocarbazoles, benzacridines and naphthenic benzacridines, and dibenzocarbazoles and naphthenic dibenzocarbazoles;

wherein the VGO-immiscible phosphonium ionic liquid comprises at least one ionic liquid selected from the group consisting of tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, tetraalkylphosphonium halides, trihexyl(tetradecyl) phosphonium chloride, trihexyl(tetradecyl)phosphonium bromide, tributyl(methyl)phosphonium bromide, tributyl(methyl)phosphonium chloride, tributyl(hexyl) phosphonium bromide, tributyl(hexyl)phosphonium chloride, tributyl(octyl)phosphonium bromide, tributyl (octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate;

wherein the refractory nitrogen compound content of the vacuum gas oil is reduced by at least 10 wt %.

2. The process of claim 1 wherein the mixture further comprises water in an amount less than about 50% relative to the amount of VGO-immiscible phosphonium ionic liquid in the mixture on a weight basis.

3. The process of claim 1 wherein the ratio of the vacuum gas oil to the VGO-immiscible phosphonium ionic liquid in the mixture ranges from about 1:1000 to about 1000:1 on a weight basis.

4. The process of claim 1 wherein the refractory nitrogen compound is reduced by greater than 40% on a weight basis.

5. The process of claim 1 further comprising passing at least a portion of the vacuum gas oil effluent to a hydrocarbon conversion process.

6. The process of claim 5 wherein said hydrocarbon conversion process comprises catalytic cracking or hydroprocessing.

7. The process of claim 1 further comprising washing at least a portion of the vacuum gas oil effluent with water to produce a washed vacuum gas oil stream and a spent water stream.

8. The process of claim 7 further comprising passing at least a portion of the washed vacuum gas oil stream to a hydrocarbon conversion process.

9. The process of claim 1 further comprising contacting the VGO-immiscible phosphonium ionic liquid effluent with a regeneration solvent and separating the VGO-immiscible phosphonium ionic liquid effluent from the regeneration solvent to produce an extract stream comprising the refractory nitrogen compound and a regenerated VGO-immiscible phosphonium ionic liquid stream.

10. The process of claim 9 further comprising recycling at least a portion of the regenerated VGO-immiscible phosphonium ionic liquid stream to the refractory nitrogen compound removal contacting step.

11. The process of claim 9 wherein the regeneration solvent comprises a lighter hydrocarbon fraction relative to the vacuum gas oil and the extract stream further comprises the lighter hydrocarbon fraction, the lighter hydrocarbon fraction being immiscible with the VGO-immiscible phosphonium ionic liquid.

12. The process of claim 9 wherein the regeneration solvent comprises water.

13. The process of claim 12 wherein the vacuum gas oil effluent comprises VGO-immiscible phosphonium ionic liquid, further comprising washing at least a portion of the vacuum gas oil effluent with water to produce a washed vacuum gas oil and a spent water stream, the spent water stream comprising the VGO-immiscible phosphonium ionic liquid; wherein at least a portion of the spent water stream is at least a portion of the regeneration solvent.

14. The process of claim 13 further comprising drying at least a portion of the regenerated VGO-immiscible phosphonium ionic liquid stream to produce a dried VGO-immiscible phosphonium ionic liquid stream and recycling at least a portion of the dried VGO-immiscible phosphonium ionic liquid stream to the refractory nitrogen compound removal contacting step.

15. A process for removing a refractory nitrogen compound from a vacuum gas oil comprising:

(a) hydroprocessing the vacuum gas oil;

(b) contacting the vacuum gas oil comprising the refractory nitrogen compound with a VGO-immiscible phosphonium ionic liquid to produce a mixture comprising the vacuum gas oil, and the VGO-immiscible phosphonium ionic liquid;

(c) separating the mixture to produce a vacuum gas oil effluent with a refractory nitrogen compound level reduced in comparison to the hydroprocessed vacuum gas oil and a VGO-immiscible phosphonium ionic liquid effluent, the VGO-immiscible phosphonium ionic liquid effluent comprising the nitrogen compound;

(d) washing at least a portion of the vacuum gas oil effluent with water to produce a washed vacuum gas oil stream and a spent water stream;

(e) contacting the VGO-immiscible phosphonium ionic liquid effluent with a regeneration solvent and separating the VGO-immiscible phosphonium ionic liquid effluent from the regeneration solvent to produce an extract stream comprising the nitrogen compound and a regenerated VGO-immiscible phosphonium ionic liquid stream; and (f) drying at least a portion of at least one of the VGO-immiscible phosphonium ionic liquid effluent, the spent water stream, and the regenerated VGO-immiscible phosphonium ionic liquid stream to produce a dried VGO-immiscible phosphonium ionic liquid stream.

16. The process of claim 15 further comprising recycling at least a portion of at least one of the VGO-immiscible phosphonium ionic liquid effluent, the spent water stream, the regenerated VGO-immiscible phosphonium ionic liquid stream, and the dried VGO-immiscible phosphonium ionic liquid stream to the refractory nitrogen compound removal contacting step.

17. The process of claim 15 wherein the refractory nitrogen compound level is reduced by at least 25% by weight.

18. A process for removing a refractory nitrogen compound from a vacuum gas oil comprising:

(a) contacting the vacuum gas oil comprising the refractory nitrogen compound with a VGO-immiscible phosphonium ionic liquid to produce a mixture comprising the vacuum gas oil, and the VGO-immiscible phosphonium ionic liquid;

(b) separating the mixture to produce a vacuum gas oil effluent with a refractory nitrogen compound level reduced by greater than 25% by weight in comparison to the vacuum gas oil and a VGO-immiscible phosphonium ionic liquid effluent, the VGO-immiscible phosphonium ionic liquid effluent comprising the nitrogen compound;

(c) contacting the VGO-immiscible phosphonium ionic liquid effluent with a regeneration solvent and separating the VGO-immiscible phosphonium ionic liquid effluent from the regeneration solvent to produce an extract stream comprising the nitrogen compound and a regenerated VGO-immiscible phosphonium ionic liquid stream;

(d) drying at least a portion of at least one of the VGO-immiscible phosphonium ionic liquid effluent, and the regenerated VGO-immiscible phosphonium ionic liquid stream to produce a dried VGO-immiscible phosphonium ionic liquid stream; and (e) passing the vacuum gas oil effluent to a hydroprocessing step wherein the desulfurization efficiency of the hydroprocessing step is greater than that obtained by hydroprocessing the untreated vacuum gas oil.

* * * * *